US008388396B2

(12) United States Patent
Hill

(10) Patent No.: US 8,388,396 B2
(45) Date of Patent: Mar. 5, 2013

(54) METHOD OF MANUFACTURING A SPARK PLUG HAVING ELECTRODE CAGE SECURED TO THE SHELL

(75) Inventor: Albert Sam Hill, Newport Beach, CA (US)

(73) Assignee: HKA Investments, LLC, Newport Beach, CA (US)

( * ) Notice: Subject to any disclaimer, the term of this patent is extended or adjusted under 35 U.S.C. 154(b) by 0 days.

(21) Appl. No.: 12/880,921

(22) Filed: Sep. 13, 2010

(65) Prior Publication Data

US 2012/0062098 A1 Mar. 15, 2012

(51) Int. Cl.
*H01T 13/20* (2006.01)
*H01T 21/02* (2006.01)

(52) U.S. Cl. ..... 445/7; 313/141; 313/140; 313/143; 123/169 EL

(58) Field of Classification Search ..... None
See application file for complete search history.

(56) References Cited

U.S. PATENT DOCUMENTS 2,147,730 A * 2/1939 Bell ..... 313/122
5,408,961 A * 4/1995 Smith ..... 123/169 R
5,936,332 A * 8/1999 Krupa et al. ..... 313/141
6,060,822 A * 5/2000 Krupa et al. ..... 313/141
6,344,707 B1 * 2/2002 Kibbey ..... 313/141
6,670,740 B2 * 12/2003 Landon, Jr. ..... 313/141
7,256,533 B2 * 8/2007 Landon, Jr. ..... 313/141
7,659,655 B2 * 2/2010 Tozzi et al. ..... 313/143
7,896,822 B2 * 3/2011 Scoseria et al. ..... 601/4
8,044,560 B2 * 10/2011 Steigleman et al. ..... 313/139
2007/0069617 A1 * 3/2007 Tozzi et al. ..... 313/140

OTHER PUBLICATIONS

Krupa, Robert; "A Spark Plug That Is Not! It is an 'Ignitron' Plasma Device"; Copyright 2004; 4 pages.

* cited by examiner

*Primary Examiner* — Sikha Roy
(74) *Attorney, Agent, or Firm* — Stetina Brunda Garred & Brucker

(57) ABSTRACT

Provided is a manufacturing method for manufacturing a spark plug which produces a spark plug which mitigates misfire and improves gas mileage, peak engine performance, horsepower, and increases the RPM range of the host vehicle. The improved performance of the spark plug is, at least in part, attributable to the spacing between an electrode body and an electrode cage. In particular, the electrode cage extends over the electrode body such that the arcuate members of the electrode cage are equidistantly spaced from the bulbous or spherical electrode body. The manufacturing method described herein results in a spark plug having the above-described configuration, while being formed and assembled at an economical cost.

19 Claims, 4 Drawing Sheets

METHOD OF MANUFACTURING A SPARK PLUG HAVING ELECTRODE CAGE SECURED TO THE SHELL

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates generally to spark plugs, and more specifically to a method of manufacturing a spark plug.

2. Description of the Related Art

Spark plugs are well-known in the art. A spark plug generally includes an elongated body having an electrical connector at one end. A pair of variable-spaced electrodes are typically provided at an opposing end, with one of the electrodes being electrically connected to the electrical connector.

In most conventional spark plugs, one of the electrodes includes a cylindrical post while the second electrode is generally J-shaped and has a portion which overlies one end of the cylindrical post. Consequently, upon the application of voltage to the cylindrical post, a spark is formed between the end of the cylindrical post and the overlying portion of the other J-shaped electrode. The spark is used to try to ignite fuel within the combustion chamber of an internal combustion engine.

In general, the electrical spark between the post and the other electrode will occur at the position of the shortest distance between the two electrodes. Consequently, in conventional spark plugs, the spark repeatedly strikes or extends between the same two surfaces on the two electrodes during operation of the spark plug, which has many associated disadvantages.

One disadvantage is that since the spark repeatedly strikes the same area on both electrodes, a portion of the electrode is repeatedly ablated by the spark, which can result in premature failure of the spark plug. Another disadvantage is the smolder caused by conventional J-shaped wire has a tendency to obstruct and divert the incoming air fuel charge, typically causing a lighting and quenching and relighting of the flame front.

A more serious disadvantage of conventional spark plugs is that due to ionization caused by the spark during operation of the spark plug, the spark plug may misfire during operation of the internal combustion engine due to the small surface firing area. For each misfire of the spark plug, the fuel within the combustion chamber is not ignited, but instead, exhausted to the atmosphere. This has an adverse affect not only on the efficiency of the engine, but it also causes fouling of the plugs and increases the exhaust of noxious fumes and pollutants to the atmosphere causing smog and possibly global warming. This is particularly critical in light of ever increasing governmental regulations and environmental concerns regarding the permissible level of emissions from spark-ignited internal combustion engines.

Recent spark plugs have been designed to address the aforementioned deficiencies. In particular, U.S. Pat. Nos. 5,936,332 and 6,060,822 both disclose a spark plug having a semispherical electrode and an arcuate semicircular electrode secure to the spark plug body adjacent semispherical electrode such that the semicircular electrode has its inner surface equidistantly spaced from the surface of the semispherical electrode.

However, difficulties have arisen in relation to manufacturing the spark plug, particularly in mass quantities. More specifically, the particular configuration and spacing between the semicircular electrode and the semispherical electrode has been difficult to mass produce in a timely and economical manner.

The present invention addresses and overcomes these deficiencies by providing a method of manufacturing the spark plugs which are more efficient then conventional spark plugs, and may be produced in a timely manner and at an economical cost. These and other advantages attendant to the present invention will be described in more detail below.

BRIEF SUMMARY OF THE INVENTION

In accordance with the present invention, there is provided a manufacturing method for manufacturing a spark plug which results in a spark plug which mitigates misfire and improves gas mileage, peak engine performance, horsepower, and increases the RPM range of the host vehicle. The improved performance of the spark plug is, at least in part, attributable to the spacing between an electrode body and an electrode cage. In particular, the electrode cage extends over the electrode body such that the arcuate members of the electrode cage are equidistantly spaced from the bulbous or spherical electrode body. The manufacturing method described herein results in a spark plug having the above-described configuration, while being formed and assembled in a timely manner and at an economical cost.

According to one embodiment, the manufacturing method includes forming an insulator having a first end portion, an opposing second end portion, and an opening extending longitudinally through the insulator from the first end portion to the second end portion. An electrode and a complimentary electrode cap are also formed. The electrode includes an electrode body and an electrode shaft having a first end portion and an opposing second end portion. The electrode body is disposed adjacent the first end portion of the electrode shaft. The electrode cap and the second end portion of the electrode shaft are configured to be cooperatively engageable with each other. A shell is also formed having a first end portion, an opposing second end portion, and an opening extending longitudinally between the first end portion and the second end portion, with the shell opening being sized to partially receive the insulator. A cage is also formed having including a plurality of arcuate members, with each arcuate member defining a respective end face. A first subassembly is assembled by connecting the electrode to the insulator. The electrode shaft is disposed within the insulator opening to dispose the electrode body adjacent the insulator first end portion. The electrode cap is connected to the electrode shaft adjacent the insulator second end portion. A second subassembly is also assembled by connecting the cage to the first end portion of the shell. The first subassembly is connected to the second subassembly, with the electrode body being disposed in close proximity to the cage to enable electrical communication therebetween.

According to one embodiment, the second subassembly is formed by forming bores within the shell, wherein the bores define a diameter at the time of formation which is slightly smaller than the diameter of the arcuate members of the cage. The shell is then heated causing the bores to expand (i.e., the diameter increases). The arcuate members of the cage are then inserted into the bores until the end face of each arcuate member is seated against the bottom of the respective bore. The shell is then cooled, causing the bore to shrink (i.e., the diameter decreases) to create a tight engagement between the shell and the cage.

The bore and cage may be specifically sized and configured such that when the cage is completely inserted within the bores (i.e., the end face of the arcuate member is abutting the bottom of the respective bore), the inner surfaces of the arcuate members are equidistantly spaced from the outer surface of the electrode body upon complete assembly of the spark plug.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
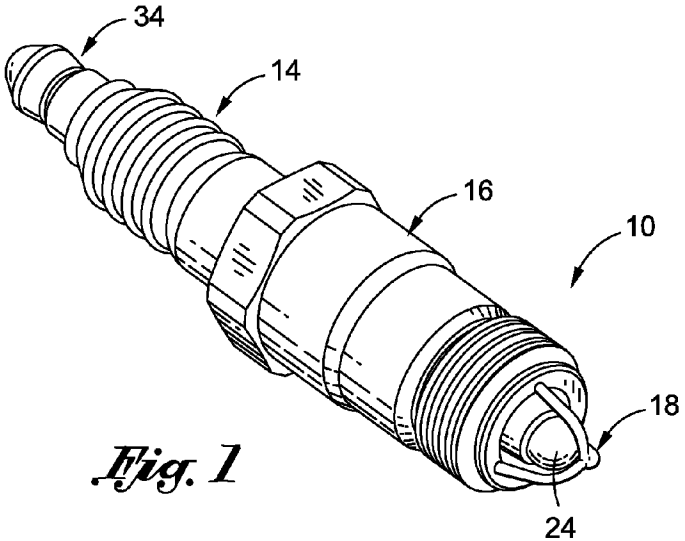
FIG. 1 is an upper perspective view of a spark plug constructed in accordance with an embodiment of the present invention.
Figure 2:
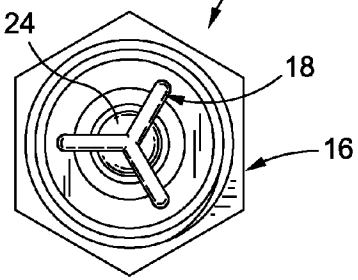
FIG. 2 is a front end view of the spark plug depicted in FIG. 1.

Referring now to the drawings, wherein the showings are for purposes of illustrating a preferred embodiment of the present invention only, and not for purposes of limiting the same, there is shown a method of manufacturing a spark plug 10 configured to mitigate misfire and improve gas mileage, peak engine performance, horsepower, and increases the RPM range of the vehicle. The manufacturing method allows for the economical formation of the uniquely configured spark plug components, as well as the unique assembly of the components to achieve the above-described performance of the spark plug 10.

Figure 3:
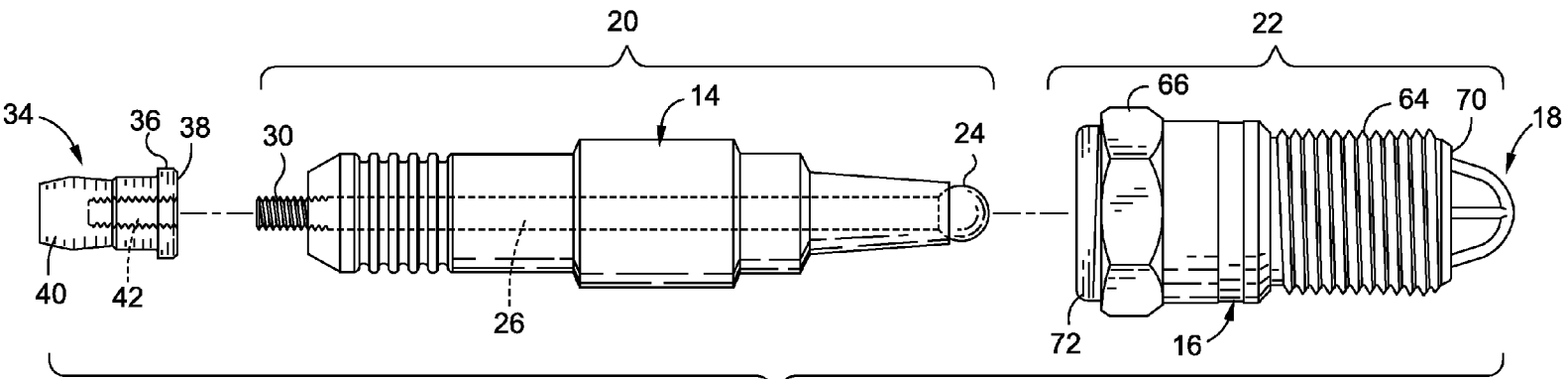
FIG. 3 is an exploded view of the spark plug having an insulator-electrode subassembly and a shell-cage subassembly.

As described in more detail below, the spark plug 10 generally includes an electrode 12 (see FIG. 4), an insulator 14, a shell 16, and an electrode cage 18. During assembly of the spark plug 10, the electrode 12 and insulator 14 are combined to form an insulator-electrode subassembly 20 (see FIG. 3), and the shell 16 and electrode cage 18 are combined to form a shell-cage subassembly 22 (see FIG. 3). The insulator-electrode assembly 20 is combined with the shell-cage subassembly 22 to form the final assembly, or spark plug 10.

The electrode 12 includes an electrode body 24 coupled to an electrode shaft 26. In the embodiment depicted in the drawings, the electrode body 24 defines a generally bulbous or spherical shape. Those skilled in the art will appreciate that the electrode body 24 may define other bulbous, non-spherical shapes, such as semispherical, without departing from the spirit and scope of the present invention. The electrode shaft 26 is generally cylindrical in shape and defines a first end portion 28 and an opposing second end portion 30. The electrode body 24 is coupled to the first end portion 28 of the electrode shaft 26 to allow for electrical communication between the electrode shaft 26 and the electrode body 24. In the preferred embodiment, the electrode body 24 and electrode shaft 26 are formed from a single sold piece (i.e., the electrode body 24 is integrally formed with the electrode shaft 26). However, it is understood that in other embodiments, the electrode body 24 may be separate from the electrode shaft 26 and may be coupled thereto via mechanical fastening (i.e., threadably engaged, friction fit, etc.).

The electrode shaft 26 preferably defines a diameter of 0.107", while the electrode body 24 defines a radius of 0.094". The electrode 12 defines a length "L" (see FIG. 4) from a second end face 32 to the center of the electrode body 24 (i.e., the central point of the electrode body 24 that the radius is measured from) preferably equal to 2.480". Those skilled in the art will appreciate that the foregoing dimensions are exemplary in nature only, and that the dimensions may be altered without departing from the spirit and scope of the present invention.

An electrode cap 34 is coupled to the second end portion 30 of the electrode shaft 26 to couple the electrode 12 to the insulator 12, as described in more detail below. The electrode cap 34 includes a proximal end portion 36 defining a proximal end face 38, and an opposing distal end portion 40. A cap cavity 42 extends longitudinally into the cap 34 from the proximal end face 38 toward the distal end portion 40. The cap cavity 42 includes internal threads, which selectively mate with external threads formed on the second end portion 30 of the electrode shaft 26. In this regard, the electrode cap 34 is screwed onto the second end portion 30 of the electrode shaft 26, which advances a portion of the electrode shaft 26 into the cap cavity 42.

The electrode 12 (i.e., electrode body 24 and electrode shaft 26) and the electrode cap 34 may be formed from beryllium copper or other metallic alloys or conducting materials known by those skilled in the art.

Figure 4:
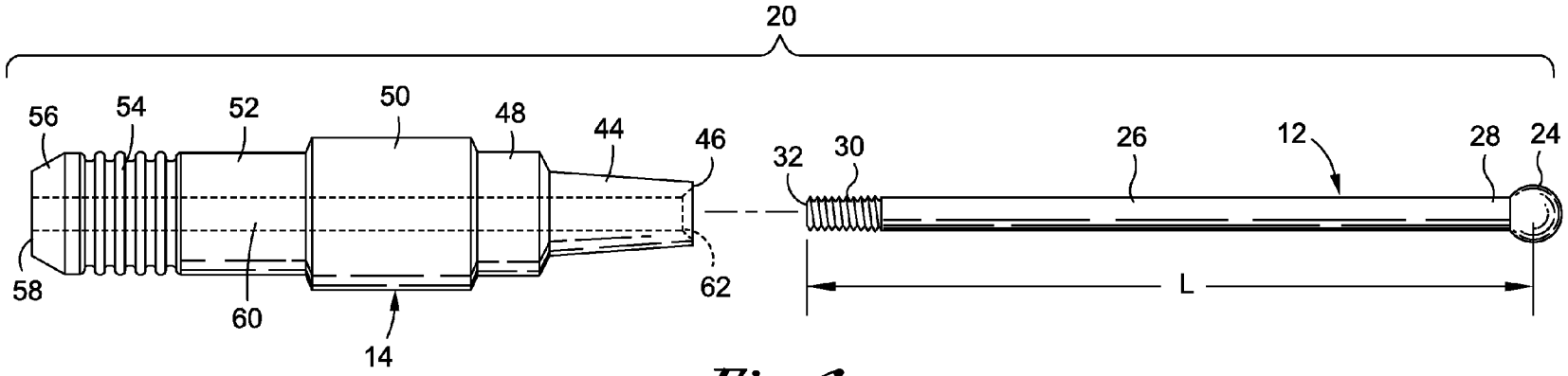
FIG. 4 is an exploded view of the insulator-electrode subassembly.
Figure 5:
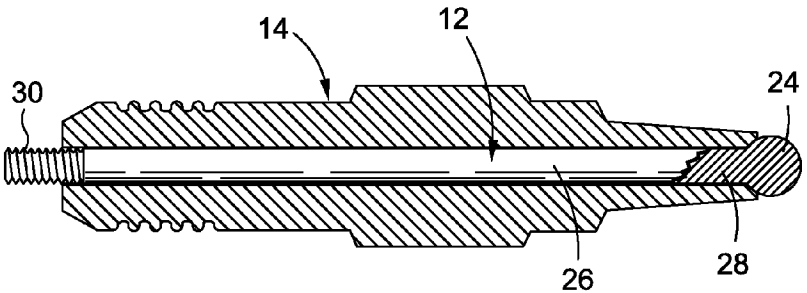
FIG. 5 is a cross sectional side view of the insulator-electrode subassembly.

Referring now to FIG. 4, there is shown an insulator 14 having several distinct sections or zones extending longitudinally along the insulator 14. More specifically, the insulator 14 includes a first tapered end portion 44 defining a first end face 46. The diameter of the first tapered end portion increases as the distance from the first end face 46 increases.

The insulator 14 further includes a first medial section 48, second medial section 50 and a third medial section 52. The first medial section 48 includes a first medial cylindrical portion and a first medial tapered portion connected to the first tapered end portion 44. The diameter of the first medial cylindrical portion 50 is substantially uniform and larger than the largest diameter of the first tapered end portion 44. In this regard, the diameter of the first medial tapered portion decreases from the first medial cylindrical portion to the first tapered end portion.

The second medial section 50 is disposed between the first medial section 48 and the third medial section 52 and has a primary tapered end portion connected to the first medial section 48 and a secondary tapered end portion connected to the third medial section 52. The diameter of the primary tapered end portion decreases from the second medial section 50 toward the first medial section 48, and the diameter of the secondary tapered end portion decreases from the second medial section 50 toward the third medial section 52.

Extending from the third medial section 52 is a ribbed section 54. A second tapered end portion 56 extends from the ribbed section 54 and terminates in a second end face 58. The diameter of the second tapered end portion 56 decreases from the ribbed section 54 to the second end face 58.

With the external configuration of the insulator 14 being described above, attention is now directed toward the internal configuration of the insulator 14. The insulator 14 includes an opening 60 extending longitudinally between the first end face 46 and the second end face 58. The opening 60 defines a diameter sized to axially receive the electrode shaft 26. A curved surface 62 extends from the opening 60 to the first end face 46 adjacent the first tapered end portion 44 of the insulator 14. The curved surface 62 is concave in shape and is complimentary to the curvature and shape of the electrode body 24 to allow the electrode body 24 to be seated adjacent the curved surface 62, as described in more detail below.

The insulator 14 may be formed from a boron nitride material, ceramic material, or other insulating materials known in the art.

Figure 6:
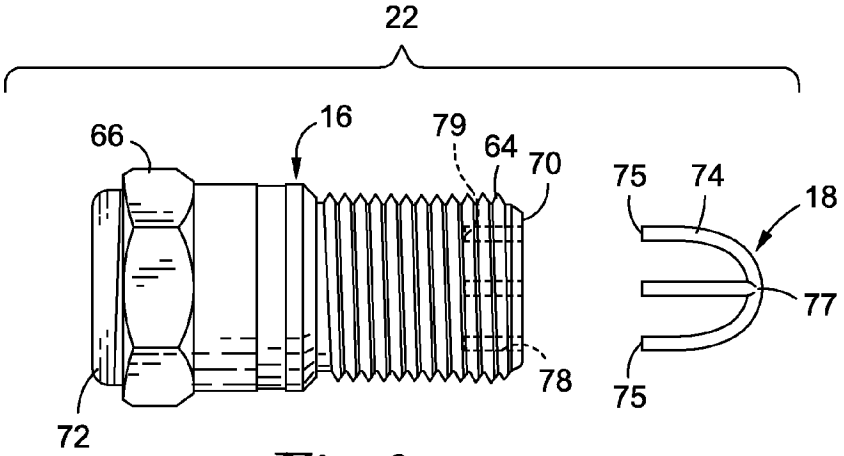
FIG. 6 is an exploded view of the shell-cage subassembly.
Figure 7:
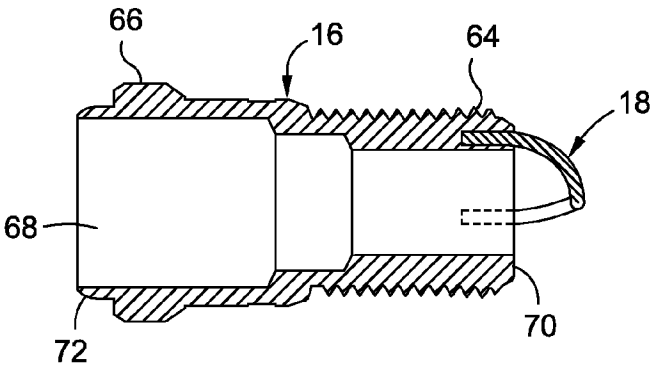
FIG. 7 is a cross sectional side view of the shell-cage subassembly.

Referring now specifically to FIGS. 6-7, the shell 16 includes a first end portion 64 and an opposing second end portion 66. An inner opening 68 extends between the first end portion 64 and the second end portion 66. The first end portion 64 defines an annular first end face 70 disposed about the inner opening 68. The first end portion 64 additionally defines a threaded portion for engaging the spark plug 10 to an internal combustion engine. A hexagonal element is disposed adjacent the second end portion 66. A cylindrical collar 72 extends axially from the hexagonal element toward the end of the second end portion 66.

Figure 9:
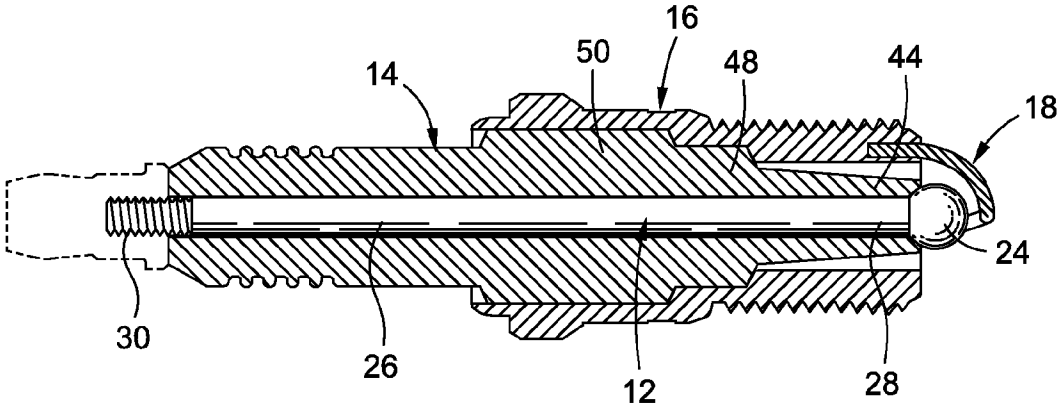
FIG. 9 is a cross sectional side view of the insulator-electrode subassembly inserted within the shell-cage subassembly.
Figure 10:
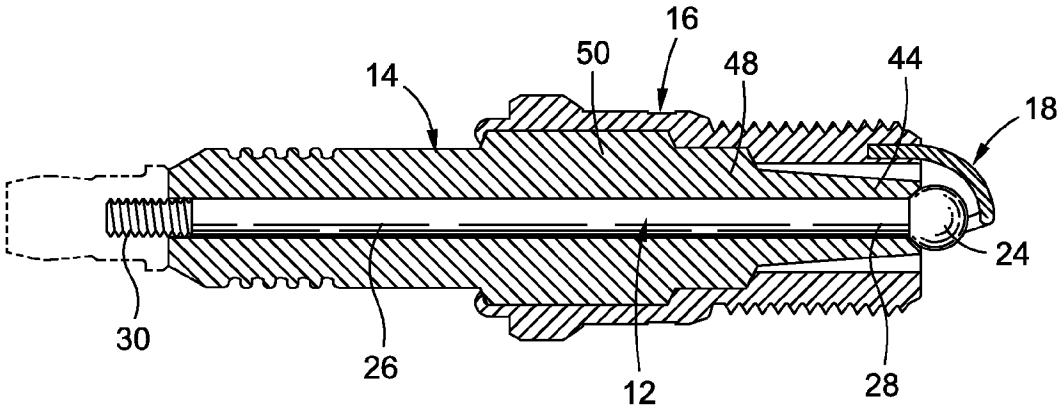
FIG. 10 is a cross sectional side view of the final assembly with the shell being crimped to connect the insulator-electrode subassembly to the shell-cage subassembly.

The inner opening 68 of the shell 16 is stepped to define different diameters along the length of the shell 16. In particular, the diameter of the inner opening 68 is largest at the second end portion 66 and the smallest at the first end portion 64. Furthermore, the inner opening 68 is sized to be complimentary to a portion of the insulator 14 to allow the insulator 14 to be received therein and engaged with the shell 16, as is best depicted in FIGS. 9 and 10. FIGS. 9-10 show that the inner opening 68 is complimentary to the second medial portion 50 and first medial portion 48 of the insulator 14. The inner opening 68 may define a diameter at the first end portion 64 which is larger than the first tapered end portion 44 of the insulator 14 to allow the first tapered end portion 44 of the insulator 14 to be easily advanced through the inner opening 68.

A semicircular electrode cage 18 is connected to the shell 16 at the first end portion 64 of the shell 16 such that the inner surface of the electrode cage 18 is facing the electrode body 24 upon final assembly of the spark plug 10. The electrode cage 18 includes a plurality of arcuate members 74 which terminate at an end face 75. As described in more detail below, the cage 18 is connected to the shell 16 such that each arcuate member 74 is equidistantly spaced along its length from the outer surface of the electrode body 24 in the final assembly. The particular electrode cage 18 depicted in the figures includes three intersecting arcuate members 74 which converge at an apex 77. The particular electrode cage 18 depicted in the drawings is exemplary in nature only and should not be viewed as limiting the scope of the present invention. For instance, other embodiments of the electrode cage 18 may include a plurality of arcuate members 74 that extend over the electrode body 24 but do not intersect with each other. Other embodiments and implementations of the electrode cage 18 are described in U.S. Pat. Nos. 5,936,332 and 6,060,822, both entitled Spark Plug, the entire disclosures of which are incorporated herein by reference.

Both the shell 16 and the electrode cage 18 are preferably formed from the same material. According to one embodiment the shell 16 and electrode cage 18 are formed from beryllium copper, although other materials known by those skilled in the art may also be used. The shell 16 and electrode cage 18 may be formed by casting. In another embodiment, the electrode cage 18 is formed by a stamping process wherein the arcuate members 74 are stamped from a metal sheet and then formed, i.e., bent around a form or die to achieve the desired shape.

Figure 8:
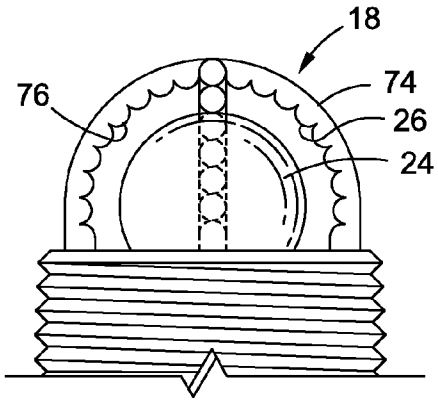
FIG. 8 is another embodiment of the cage connected to the shell.

According to one particular implementation and referring now specifically to FIG. 8, the electrode cage 18 includes a plurality of nodules 76 formed along the inner surface of the arcuate members 74. The nodules 76 are preferably immediately adjacent to each other and extend along substantially the entire length of the arcuate member 74. It has been found that the provision of the nudules 74 enhances the combustion efficiency of the spark plug 10 and thus improves fuel economy and engine efficiency.

After all of the above-described elements are formed, they are preferably assembled as described below to form the spark plug 10. The insulator-electrode assembly 20 is formed by connecting the electrode 12 to the insulator 14 by inserting the second end portion 30 of the electrode shaft 26 through the insulator opening 60 until the electrode body 24 is seated against the curved surface 62 of the insulator 14. A portion of the electrode shaft 26 should protrude from the second end portion of the insulator 14. The electrode cap 34 is then screwed onto the threaded portion of the electrode shaft 26 to secure the electrode 12 to the insulator 14.

The shell 16 is prepared for assembly to the electrode cage 18 by forming a plurality of bores 78 within the shell 16, wherein each bore 78 extends into the shell 16 from the first end face 70. The innermost surface of the bore 78 defines an inner bore face 79. The number of bores 78 formed within the end face 70 preferably is equal to the number of arcuate members 74 included in the electrode cage 18. Each arcuate member 74 preferably defines a diameter of 0.040". The bores 78 are preferably formed to define a depth of approximately 1/16"-1/2" and a diameter slightly smaller than the diameter of the arcuate members 74. In this regard, once the bores 78 are formed, the shell 16 is heated to a temperature which causes the diameter of the bores 78 to thermally expand. The arcuate members 74 are maintained at a cooler temperature and are inserted into the expanded bores 78. The arcuate members 74 are inserted into the respective bores 78 until the arcuate members 74 bottom out to insure correct spacing. The shell 16 is then allowed to cool with the arcuate members 74 maintained within the bores 78. As the shell 16 cools, the bores 78 thermally contract to rigidly capture the arcuate members 74 to secure the arcuate members 74 to the shell 16. The bores 78 are additionally sized such that when the arcuate members 74 are completely inserted into the bores 78, the arcuate members 74 are equidistantly spaced from the electrode body 24 (upon insertion of the electrode-insulator sub-assembly 20 into the shell-cage sub-assembly 22). Preferably, the heating and cooling of the bores 78 causes the diameter of the bores 78 to thermally expand/contract approximately 0.001"-0.005", although the exact amount may vary depending on the size of the components and the materials used.

It should be noted that the above-described method of securing the cage 18 to the shell 16 is sufficient for maintaining such engagement in the elevated temperatures commonly experienced in an internal combustion engine. In particular, the method of securing the cage 18 to the shell 16 includes the step of heating the shell 16 while maintaining the cage 18 at a cooler temperature. In this manner, the bores 78 formed within the shell 16 thermally expand, while the cage 18 remains in an unexpanded condition. When the shell 16 subsequently cools, the bores 78 thermally contract to secure the cage 18 to the shell 16. However, when the spark plug 10 is used in an internal combustion engine, as the temperature within the engine increases, the temperature of the cage 18 and the shell 16 both increase (rather than just the temperature of the shell 16), which may cause thermal expansion of both the cage 18 and shell 16. In this regard, the diameter of the arcuate members 74 may thermally expand at the same rate or the same amount as the diameter of the bores 78 to maintain the engagement between the cage 18 and the shell 16.

Once the shell-cage subassembly 22 and insulator-electrode subassembly 20 are formed, the subassemblies 20, 22 are combined to form the final assembly or spark plug 10. In particular, the first end portion of the insulator 14 is inserted into the inner opening 68 of the shell 16 at the second end portion 66 thereof, and advanced toward the first end portion 64 of the shell 16 until the outer surface of the insulator 14 is seated against the inner surface of the shell 16. The ring-like collar 72 on the shell 16 may then be crimped or bent radially inwardly to secure the insulator 14 to the shell 16.

In operation, the spark plug 10 is configured to receive an electrical voltage at the electrode shaft 26 and conduct the electrical voltage to the electrode body 24. The voltage potential between the electrode body 24 and the electrode cage 18 causes a spark to extend between the electrode body 24 and the electrode cage 18. The spark ignites fuel within the engine combustion chamber. It is contemplated that the spark plug 10 is configured for use with any combustible gas or liquid including water.

As a result of the outer surface of the electrode body 24 being equidistantly spaced from the inner surface of the electrode cage 18, repeated sparking of the spark plug 10 causes the spark to "walk along" the adjacent surfaces of the electrode body 24 and the electrode cage 18 so that the spark typically does not extend between the same spots on the electrode body 24 and electrode cage 18, as in conventional spark plugs. Thus, the spark plug 10 not only exhibits an immensely longer life, but also mitigates misfirings of the spark plug 10 and greatly reduces emissions from the engine by operating at an air-to-fuel ratio of approximately 24:1.

This disclosure provides an exemplary embodiment of the present invention. The scope of the present invention is not limited by this exemplary embodiment. Numerous variations, whether explicitly provided for by the specification or implied by the specification, such as variations in structure, dimension, type of material and manufacturing process may be implemented by one of skill in the art in view of this disclosure.

What is claimed is:

1. A method of manufacturing a spark plug, the method comprising the steps of:

a) forming an insulator having a first end portion, an opposing second end portion, and an opening extending longitudinally through the insulator from the first end portion to the second end portion;

b) forming an electrode and a complimentary electrode cap, the electrode having an electrode body and an electrode shaft having a first end portion and an opposing second end portion, the electrode body being disposed adjacent the first end portion of the electrode shaft, the electrode cap and the second end portion of the electrode shaft being configured to be cooperatively engageable with each other;

c) forming a shell having a first end portion defining a transverse end face, an opposing second end portion, and an opening extending longitudinally between the first end portion and the second end portion, the shell opening being sized to partially receive the insulator, the shell further including a plurality of bores extending longitudinally into the shell from the transverse end face;

d) forming a cage including a plurality of arcuate members, each arcuate member defining an end face;

e) assembling a first subassembly by connecting the electrode to the insulator, the electrode shaft being disposed within the insulator opening to dispose the electrode body adjacent the insulator first end portion, the electrode cap being connected to the electrode shaft adjacent the insulator second end portion;

f) heating the shell to cause the plurality of bores to expand;

g) inserting the plurality of arcuate members into respective ones of the plurality of bores in their expanded state;

h) cooling the shell causing the plurality of bores to contract to secure the cage to the shell to define a second subassembly; and i) connecting the first subassembly to the second subassembly, the electrode body being disposed in close proximity to the cage to enable electrical communication therebetween.

2. The method recited in claim 1, wherein step a) includes forming the insulator from boron nitride.

3. The method recited in claim 1, wherein step b) includes forming the electrode to include a bulbous electrode body.

4. The method recited in claim 3, wherein step b) includes forming the electrode to include a spherical electrode body.

5. The method recited in claim 1, wherein step b) includes forming the electrode shaft and the electrode cap to be threadably connectable to each other.

6. The method recited in claim 1, wherein step b) includes forming the electrode from beryllium copper.

7. The method recited in claim 1, wherein steps c) and d) includes forming the shell and cage from beryllium copper.

8. The method recited in claim 1, wherein steps b)-i) include forming the shell, electrode and cage to be sized and configured to define equidistant spacing between the plurality of arcuate members and the electrode body upon connection of the first subassembly and the second subassembly.

9. The method recited in claim 8, wherein in step c) each bore defines an inner bore face, and in step g), each arcuate member is inserted into a respective one of the plurality of bores until the respective end face of the arcuate member is disposed in contact with the respective inner bore face.

10. The method recited in claim 1, wherein step c) includes forming the shell to include a ring extending axially adjacent the first end portion, and in step i) the ring is crimped to secure the first subassembly to the second subassembly.

11. The method recited in claim 1, wherein step d) includes forming the cage including a plurality of intersecting arcuate members.

12. The method recited in claim 1, wherein step d) includes forming the cage through a stamping process.

13. A method of manufacturing a spark plug having a shell and an electrode cage, the shell defining a transverse end face, and a plurality of bores extending longitudinally into the shell from the transverse end face, the electrode cage including a plurality of arcuate members, the method comprising the steps of:

a) heating the shell to thermally expand the respective diameters of the plurality of bores;

b) inserting the plurality of arcuate members into respective ones of the plurality of bores; and c) cooling the shell with the plurality of arcuate members inserted within the plurality of bores to thermally contract the respective diameters of the plurality of bores to rigidly capture the cage to the shell.

14. The method recited in claim 13, wherein each bore defines an inner bore face in the shell, and in step b), each arcuate member defines an end face such that when each arcuate member is inserted into a respective one of the plurality of bores, the respective end face of the arcuate member is disposed in contact with the respective inner bore face.

15. A method of manufacturing a spark plug, the method comprising the steps of:

a) forming an insulator having a first end portion, an opposing second end portion, and an opening extending through the insulator from the first end portion to the second end portion;

b) forming an electrode and an electrode cap, the electrode having an electrode body and an electrode shaft having a first end portion and an opposing second end portion, the electrode body being disposed adjacent the first end portion of the electrode shaft, the electrode cap and the electrode shaft being configured to be engageable with each other;

c) forming a shell having an opening sized to partially receive the insulator, the shell defining a transverse end face adjacent the first end portion, and a plurality of bores extending longitudinally into the shell from the transverse end face;

d) forming a cage including a plurality of arm members;

e) assembling a first subassembly by connecting the electrode to the insulator, the electrode shaft being disposed within the insulator opening, the electrode cap being connected to the electrode shaft;

f) heating the shell to cause the plurality of bores to expand;

g) inserting the plurality of arm members into respective ones of the plurality of bores in their expanded state;

h) cooling the shell causing the plurality of bores to contract to secure the cage to the shell to define a second subassembly; and i) connecting the first subassembly to the second subassembly, the electrode body being disposed in close proximity to the cage to enable electrical communication therebetween.

16. The method recited in claim 15, wherein step b) includes forming the electrode to include a spherical electrode body.

17. The method recited in claim 15, wherein in step c) each bore defines an inner bore face, and in step f), each arm member is inserted into a respective one of the plurality of bores until the respective end face of the arm member is disposed in contact with the respective inner bore face.

18. The method recited in claim 15, wherein step c) includes forming the shell to include a ring extending axially adjacent the first end portion, and in step g) the ring is crimped to secure the first subassembly to the second subassembly.

19. The method recited in claim 15, wherein step d) includes forming the cage including a plurality of intersecting arcuate arm members.

* * * * *